US008585185B2

(12) United States Patent
Nystrom et al.

(10) Patent No.: US 8,585,185 B2
(45) Date of Patent: Nov. 19, 2013

(54) HIGH DENSITY ELECTRICAL INTERCONNECT USING LIMITED DENSITY FLEX CIRCUITS

(75) Inventors: Peter J Nystrom, Webster, NY (US); Scott Taylor Treece, Portland, OR (US); Bryan R Dolan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 17 days.

(21) Appl. No.: 13/240,829

(22) Filed: Sep. 22, 2011

(65) Prior Publication Data

US 2013/0076839 A1 Mar. 28, 2013

(51) Int. Cl.
*B41J 2/045* (2006.01)

(52) U.S. Cl.
USPC ..... 347/68; 347/71; 347/72; 347/50; 347/58

(58) Field of Classification Search
USPC ..... 347/68–72, 50, 57–59
See application file for complete search history.

(56) References Cited

U.S. PATENT DOCUMENTS

| | | | | |
|---|---|---|---|---|
| 7,338,151 | B1 * | 3/2008 | Samura | 347/70 |
| 7,445,314 | B2 * | 11/2008 | Lee et al. | 347/45 |
| 2003/0112298 | A1 * | 6/2003 | Sato et al. | 347/68 |
| 2005/0062806 | A1 * | 3/2005 | Terakura et al. | 347/72 |
| 2007/0063206 | A1 * | 3/2007 | Maeda | 257/88 |
| 2008/0239022 | A1 * | 10/2008 | Andrews et al. | 347/71 |
| 2008/0316255 | A1 * | 12/2008 | Kubo et al. | 347/40 |
| 2011/0279552 | A1 * | 11/2011 | Yoshida et al. | 347/70 |

OTHER PUBLICATIONS

Stephens et al., "Electrical Interconnect Using Embossed Contacts on a Flex Circuit", U.S. Appl. No. 12/795,605, filed Jun. 7, 2010.
Nystrom et al., "High Density Electrical Interconnect for Printing Devices Using Flex Circuits and Dielectric Underfill", U.S. Appl. No. 13/097,182, filed Apr. 29, 2011.
Dolan et al., "Polymer Layer Removal on PZT Arrays Using a Plasma Etch", U.S. Appl. No. 13/011,409, filed Jan. 21, 2011.
Dolan et al., "Method for Interstital Polymer Planarization Using a Flexible Flat Plate", U.S. Appl. No. 13/165,765, filed Jun. 21, 2011.

* cited by examiner

*Primary Examiner* — Henok Legesse
(74) *Attorney, Agent, or Firm* — MH2 Technology Law Group LLP

(57) ABSTRACT

A method and structure for an ink jet print head which includes the use of two or more flexible circuits and a piezoelectric element array. A first pad array is included on a first flex circuit to power a first portion of the piezoelectric element array of the print head, and a second pad array is included on a second flex circuit to power a second portion of the piezoelectric element array of the print head. Using two flex circuits requires only half as many traces to be formed on each flex circuit, which can relax spacing requirements and design tolerances.

9 Claims, 7 Drawing Sheets

HIGH DENSITY ELECTRICAL INTERCONNECT USING LIMITED DENSITY FLEX CIRCUITS

FIELD OF THE INVENTION

The present teachings relate to the field of ink jet printing devices, and more particularly to a high density piezoelectric ink jet print head and methods of making a high density piezoelectric ink jet print head and a printer including a high density piezoelectric ink jet print head.

BACKGROUND OF THE INVENTION

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and reduce or eliminate problems with kogation.

Piezoelectric ink jet print heads typically include a flexible diaphragm and an array of piezoelectric elements (transducers) attached to the diaphragm. When a voltage is applied to a piezoelectric element, typically through electrical connection with an electrode electrically coupled to a voltage source, the piezoelectric element bends or deflects, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. One way to increase the resolution is to increase the density of the piezoelectric elements.

As resolution and density of the print heads increase, the area available to provide electrical interconnects decreases. Routing of other functions within the head, such as ink feed structures, competes for this reduced space and places restrictions on the types of materials used. For example, current technology for use with a 600 dots-per-inch (DPI) print head can include parallel electrical traces on the flex circuit with each trace electrically connected to a pad (i.e., electrode) of the pad array (i.e., electrode array) of the flex circuit. The parallel traces can have a 38 micrometer (μm) pitch, a 16 μm trace width, leaving a 22 μm space between each trace. As print head densities increase, current flex circuit design practices will require formation of traces and pads having tighter tolerances and smaller feature sizes.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

An embodiment of the present teachings can include a method for forming an ink jet print head including electrically coupling a plurality of pads of a first flexible circuit (flex circuit) to a first plurality of piezoelectric elements of a piezoelectric element array and electrically coupling a plurality of pads of a second flex circuit to a second plurality of piezoelectric elements of the piezoelectric element array, wherein the first plurality of piezoelectric elements is different from the second plurality of piezoelectric elements and each piezoelectric element of the first and second plurality of piezoelectric elements is individually addressable through one of the first plurality of pads and the second plurality of pads.

Another embodiment of the present teachings can include an ink jet print head including a plurality of pads of a first flex circuit electrically coupled to a first plurality of piezoelectric elements of a piezoelectric element array and a plurality of pads of a second flex circuit electrically coupled to a second plurality of piezoelectric elements of the piezoelectric element array, wherein the first plurality of piezoelectric elements is different from the second plurality of piezoelectric elements and each piezoelectric element of the first and second plurality of piezoelectric elements is configured to be individually addressable through one of the first plurality of pads and the second plurality of pads.

In another embodiment of the present teachings, a printer can include an ink jet print head including a plurality of pads of a first flex circuit electrically coupled to a first plurality of piezoelectric elements of a piezoelectric element array and a plurality of pads of a second flex circuit electrically coupled to a second plurality of piezoelectric elements of the piezoelectric element array. The first plurality of piezoelectric elements is different from the second plurality of piezoelectric elements. Each piezoelectric element of the first and second plurality of piezoelectric elements is configured to be individually addressable through one of the first plurality of pads and the second plurality of pads. The printer can further include a manifold physically attached to the first and second flex circuits and an ink reservoir formed by a surface of the manifold.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. may have been simplified and drawn to facilitate understanding of the inventive embodiments rather than to maintain strict structural accuracy, detail, and scale.

DESCRIPTION OF THE EMBODIMENTS

Reference will now be made in detail to embodiments of the present teachings, an example of which is illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "polymer" encompasses any one of a broad range of carbon-based compounds formed from long-chain molecules including thermoset polyimides, thermoplastics, resins, polycarbonates, epoxies, and related compounds known to the art.

The formation and use of a print head is discussed in U.S. patent Ser. No. 13/011,409, titled "Polymer Layer Removal on PZT Arrays Using A Plasma Etch," filed Jan. 21, 2011, which is incorporated herein by reference in its entirety.

Designs of print head flex circuits which electrically connect to the piezoelectric elements route a plurality of traces between adjacent pads of the flex circuit pad array. Each pad of the flex circuit pad array is electrically coupled to a unique piezoelectric element. Using current flex circuit design and manufacturing techniques, increasing the print head density will require an increase in the number of traces, because each pad of the pad array must be attached to a unique trace such that each piezoelectric element is individually addressable. Because the density of the pads on the flex circuit will increase, a larger number of traces will have to be routed between adjacent pads. To double the printhead density will require double the number of traces between each pad, while the spacing between adjacent pads will decrease.

Figure 1:
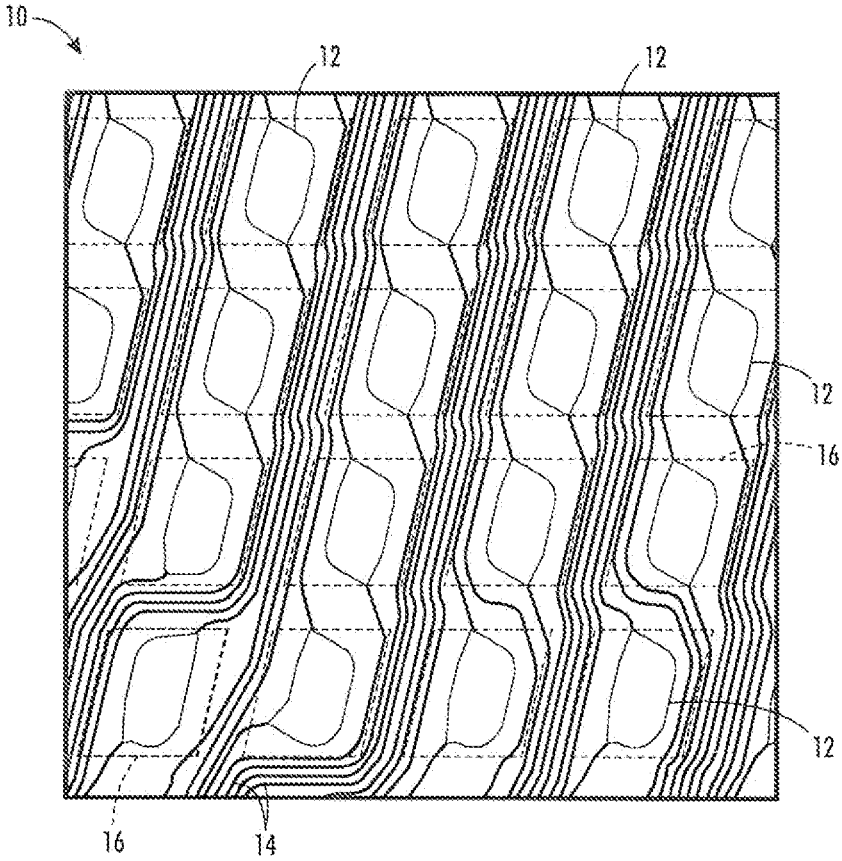
FIG. 1 is a transparent perspective view of a flex circuit attached to a piezoelectric element array.

An example of a print head flex circuit 10 is depicted in the schematic perspective view of FIG. 1. The flex circuit 10 includes a pad array having a plurality of pads 12, and a plurality of traces 14 routed between each pad 12. With the FIG. 1 example, eight traces 14 are routed between each pair of adjacent pads 12. A trace 14 is electrically coupled to each pad 12. FIG. 1 further depicts a plurality of piezoelectric elements 16 which underlie the flex circuit 10, with each pad 12 electrically coupled to a piezoelectric element 16 using a conductor (not individually depicted). It will be appreciated that the piezoelectric elements 16 would not be visible under the flex circuit 10. By applying a voltage to an individual trace 14 unique to each pad 12, each piezoelectric element 16 can be individually addressed through a pad 12 of the pad array. Additionally, a plating trace is coupled to each pad 12 and routed off the edge of the flex circuit to allow for metal plating of the flex circuit metal features.

In the example of a 600 DPI print head described above, the parallel traces 14 can have a 38 μm pitch and a 16 μm trace width, which leaves a 22 μm space between each trace. As the density of piezoelectric elements increases, the density of the pad array will also increase, as will the number of traces. Thus more traces 14 will need to be formed between each pair of adjacent pads 12 in a narrower available space between adjacent pads 12. In an embodiment, trace pitch may be reduced to 20 μm, which would require a significant improvement in current flex circuit manufacturing capabilities.

An embodiment of the present teachings can be used to provide a higher print head piezoelectric element density using current flex circuit manufacturing techniques. The present teachings can include the use of two or more different flex circuits, with each of the flex circuits attached to a different portion of the piezoelectric element array. The use of multiple flex circuits may also simplify rework over devices which use a single flex circuit, thereby decreasing scrap and rework costs. For example, the first flex circuit can be attached to the piezoelectric elements and then the electrical connections to the piezoelectric elements can be electrically tested before attaching and testing the second flex circuit. If necessary, one or more electrical connections of the first flex circuit to the piezoelectric elements can be reworked or the first flex circuit can be replaced prior to attaching and testing the second flex circuit. Any number of separate flex circuits can provide electrical contact to the array of piezoelectric elements.

An embodiment of the present teachings can include the formation of a jet stack, a print head, and a printer including the print head. In the perspective view of FIG. 2, a piezoelectric element layer 20 is detachably bonded to a transfer carrier 22 with an adhesive 24. The piezoelectric element layer 20 can include, for example, a lead-zirconate-titanate layer between about 25 μm to about 150 μm thick to function as an inner dielectric. The piezoelectric element layer 20 can be plated on both sides with nickel, for example, using an electroless plating process to provide conductive layers on each side of the dielectric PZT. The nickel-plated PZT functions essentially as a parallel plate capacitor which develops a difference in voltage potential across the inner PZT material. The carrier 22 can include a metal sheet, a plastic sheet, or another transfer carrier. The adhesive layer 24 which attaches the piezoelectric element layer 20 to the transfer carrier 22 can include a dicing tape, thermoplastic, or another adhesive. In another embodiment, the transfer carrier 22 can be a material such as a self-adhesive thermoplastic layer such that a separate adhesive layer 24 is not required.

Figure 2:
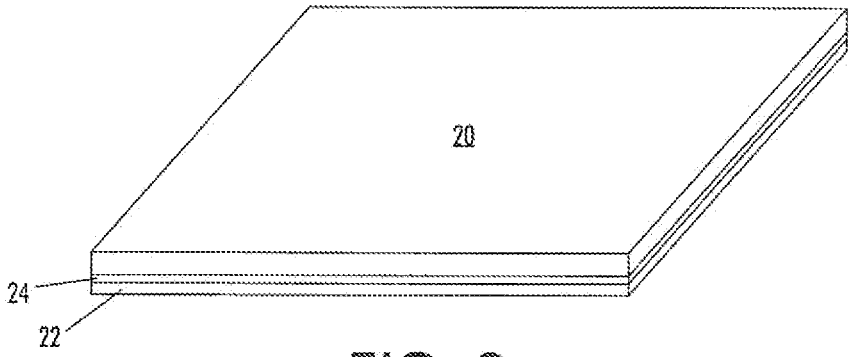
FIGS. 2 and 3 are perspective views of intermediate piezoelectric elements of an in-process device in accordance with an embodiment of the present teachings.
Figure 3:
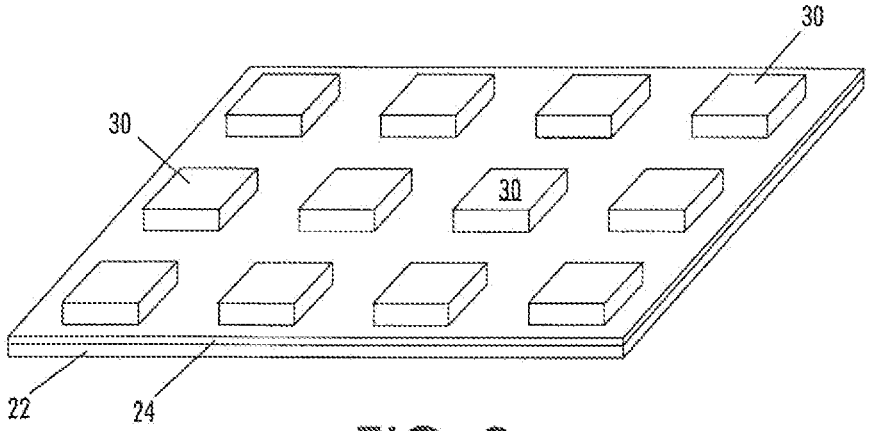

After forming the FIG. 2 structure, the piezoelectric element layer 20 is diced to form a plurality of individual piezoelectric elements 30 as depicted in FIG. 3. It will be appreciated that while FIG. 3 depicts 4×3 array of piezoelectric elements, a larger array can be formed. For example, a 1200 DPI print head can have an array of piezoelectric elements which is about 24× about 150 elements, or other sizes. The dicing can be performed using mechanical techniques such as with a saw such as a wafer dicing saw, using a dry etching process, using a laser ablation process, etc. To ensure complete separation of each adjacent piezoelectric element 30, the dicing process can terminate after removing a portion of the adhesive 24 and stopping on the transfer carrier 22, or after dicing through the adhesive 24 and part way into the carrier 22. In this embodiment, assuming a 1200 DPI piezoelectric element array, spacing between adjacent piezoelectric elements can be about 100 μm or less, and piezoelectric element pitch can be about 500 μm or less, and the piezoelectric elements can have a pitch of between about 400 μm and about 700 μm.

Figure 4:
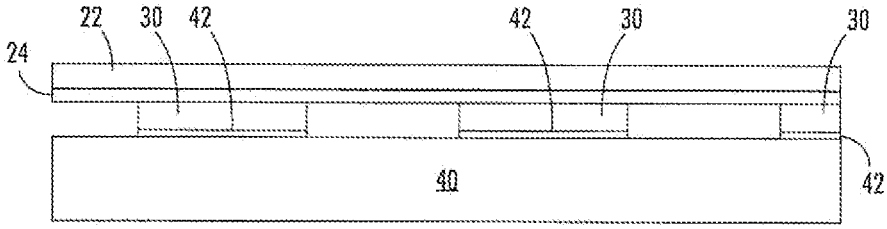
FIGS. 4-7 are cross sections depicting the formation of a jet stack for an ink jet print head.

After forming the individual piezoelectric elements 30, the FIG. 3 assembly can be attached to a jet stack subassembly 40 as depicted in the cross section of FIG. 4. The FIG. 4 cross section is magnified from the FIG. 3 structure for improved detail, and depicts cross sections of one partial and two complete piezoelectric elements 30. The jet stack subassembly 40 can be manufactured using known techniques in any number of jet stack designs, and is depicted in block form for simplicity. In an embodiment, the FIG. 3 structure can be attached to the jet stack subassembly 40 using an adhesive 42. For example, a measured quantity of adhesive 42 can be dispensed, screen printed, rolled, etc., onto either the upper surface of the piezoelectric elements 30, onto the upper surface of the jet stack subassembly 40, or both. In an embodiment, a single drop of adhesive 42 can be placed onto the jet stack subassembly 40 for each individual piezoelectric element 30. After applying the adhesive, the jet stack subassembly 40 and the piezoelectric elements 30 are aligned with each other, then the piezoelectric elements 30 are mechanically connected to the jet stack subassembly 40 with the adhesive 42. The adhesive 42 is cured by techniques appropriate for the adhesive to result in the FIG. 4 structure.

Figure 5:
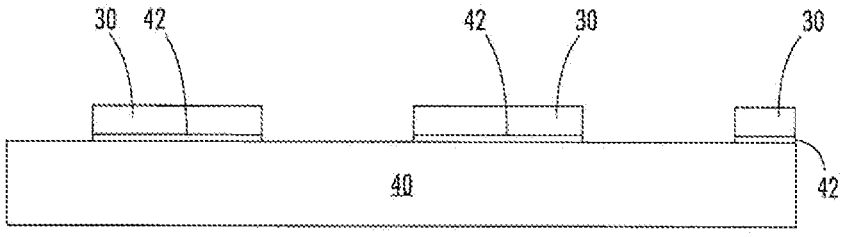

Subsequently, the transfer carrier 22 and the adhesive 24 are removed from the FIG. 4 structure to result in the structure of FIG. 5.

Figure 6:
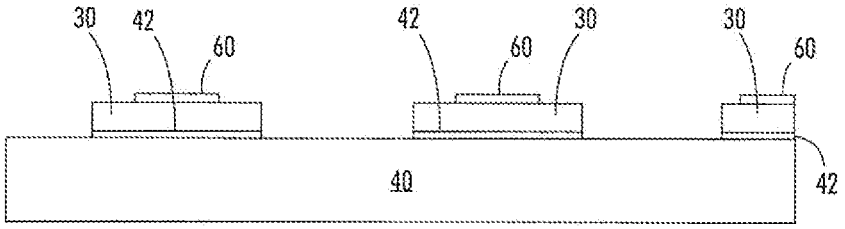

Next, a conductor 60 can be formed within each opening on each exposed piezoelectric element 30 as depicted in FIG. 6, for example by screen printing, chemical vapor deposition, drop (microdrop) dispensing, etc., to electrically contact each piezoelectric element 30.

Figure 7:
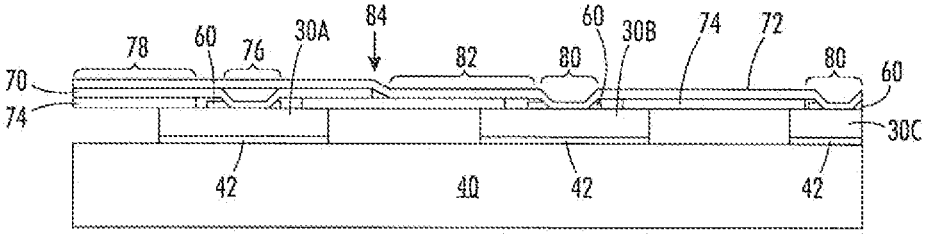

Next, a first flex circuit 70 and a second flex circuit 72 are attached to the FIG. 6 structure as depicted in the schematic cross section of FIG. 7. The first flex circuit 70 can be physically attached to the piezoelectric element array 30 using an adhesive 74. The second flex circuit 72 can be physically attached to the first flex circuit 70 and to the piezoelectric element array using an adhesive (not individually depicted for simplicity) such that a portion of the second flex circuit 72 is placed on top of the first flex circuit 70. In this embodiment, a portion of the second flex circuit 72 overlies at least a portion of the first flex circuit 70 such that at least a portion of the first flex circuit 70 is interposed between the second flex circuit 72 and the piezoelectric element array 30. It will be understood that the flex circuits can include one or more conductive layers and one or more dielectric layers which have not been individually depicted for simplicity. An array of pads (i.e., bump electrodes) 76 of the first flex circuit 70 is electrically connected to a first portion of the array of piezoelectric elements 30 using conductor 60. FIG. 7 depicts a single piezoelectric element 30A of the first portion of the array of piezoelectric elements, but it will be understood that the first flex circuit 70 can be electrically connected with each of piezoelectric element of a first half the piezoelectric element array. The first flex circuit can also include a plurality of traces 78 such that each piezoelectric element 30 of the first half of the piezoelectric element array is individually addressable through the first flex circuit 70 through a voltage applied to each trace 78. An array of pads or bump electrodes 80 of the second flex circuit 72 is electrically connected to a second portion of the array of piezoelectric elements 30 using the conductor 60. FIG. 7 depicts two piezoelectric elements 30B, 30C of the second portion of the array of piezoelectric elements, but it will be understood that the second flex circuit 72 can be electrically connected with a second half of the piezoelectric element array. The second flex circuit can also include a plurality of traces 82 such that each piezoelectric element 30 of the second half of the piezoelectric element array is individually addressable through the second flex circuit 72 through a voltage applied to each trace 82.

In this embodiment, where a spacing between adjacent piezoelectric elements is between about 50 μm and about 150 μm, the traces 78, 82 on each flex circuit 70, 72 which are routed in the spacing between adjacent pads 76, 80 can have a width of between about 14 μm and about 25 μm, and a pitch of between about 24 μm and about 50 μm. If the pads and traces were formed on a single flex circuit, trace widths would have to be between 7 μm and 12 μm, and trace pitch would have to be between 14 μm and 24 μm, because twice the number of traces would have to be formed between adjacent pads.

A feature which allows the overlap of flex circuits is the ability of the second flex circuit 72 to span the edge of the first flex circuit and to conform to a vertical step 84. In order to maintain a piezoelectric element and/or a flex circuit array row pitch on the order of 500 μm, the second flex circuit 72 should be able to make the vertical step 84 across the edge of the first flex circuit 70, which overlies the piezoelectric element array as depicted in FIG. 7. In an embodiment, a dielectric sheet (not individually depicted) of the first flex circuit onto which the conductive flex circuit trace material is formed can, be about 38 μm thick, plus metal, plus coverlay/solder mask yielding a total vertical step 84 of as much as 100 μm, but typically somewhat less. The flex circuits 70, 72 can be formed by embossing, for example as described in U.S. patent Ser. No. 13/097,182, filed Apr. 29, 2011, the disclosure of which is incorporated herein by reference in its entirety, and/or using a process described in U.S. patent application Ser. No. 12/795,605 which was incorporated by reference above. When embossing a flex circuit using a post and die, 100 μm bumps can be achieved to form pads 76, 80 with a step distance on the order of 100 μm, or a 1:1 aspect ratio. As these bumps are created directly in the trace metallization, a stepped seam across the width of the flex circuit can be formed in a similar manner with similar reliability.

Figure 8:
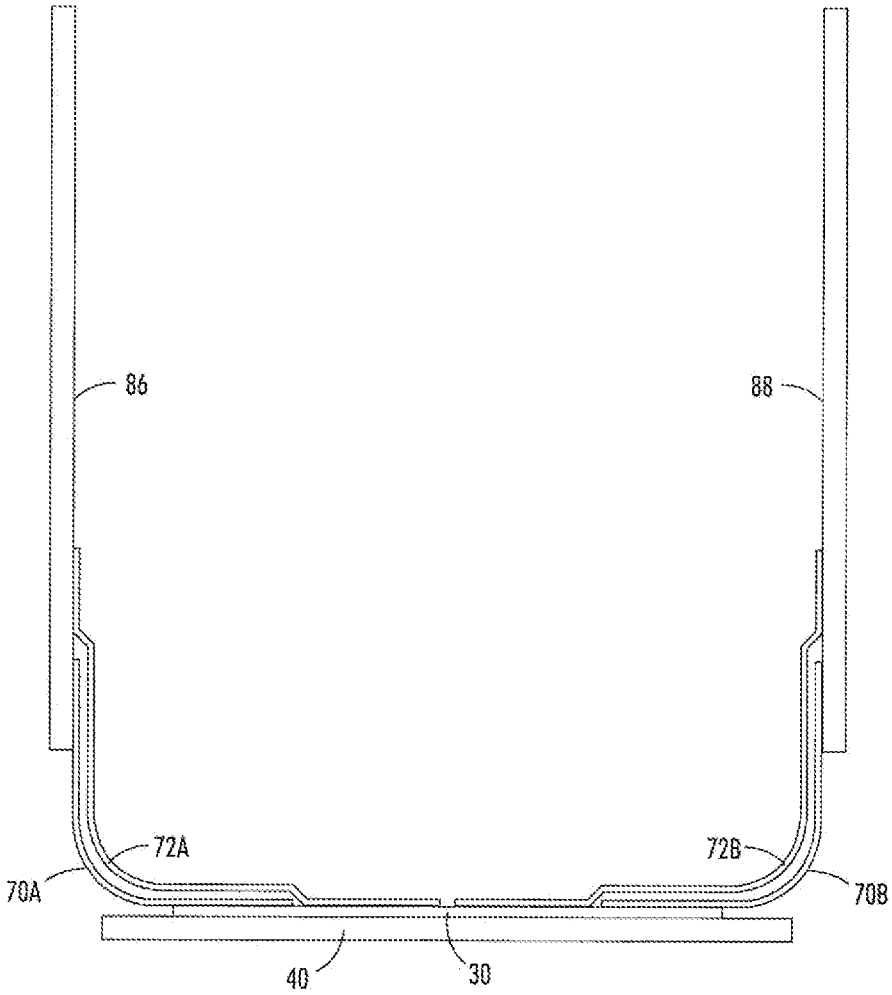
FIG. 8 is a cross section depicting flex circuits attached to a piezoelectric element array and to a pair of driver boards.

FIG. 8 is a schematic cross section depicting the electrical path of the flex circuits 70, 72. FIG. 8 depicts the FIG. 7 structure after attachment of a first half 70A of the first flex circuit 70 and a first half 72A of the second flex circuit 72 to a first driver board 86. Additionally, a second half 70B of the first flex circuit 70 and a second half 72B of the second flex circuit 72 can be attached to a second driver board 88. In this instance, flex circuit portions 70A, 70B, 72A, and 72B can be four separate flex circuits which are electrically isolated from each other. Any number of stacked flex circuits can be used. For simplicity, a bulk of the fluid path behind the print head/flex circuit area in the FIG. 8 structure is not depicted.

In an embodiment, the flex circuits 70, 72 can include a plurality of pads 76, 80 and a plurality of traces 78, 82 which are provided by a single conductive layer. The single conductive layer can be formed as a planar layer then punched or stamped to shape using a press to form the contoured pads. In the embodiment depicted, each trace 78, 82 is electrically coupled to one of the conductive pads 76, 80 and each conductive pad 76, 80 is electrically coupled to one of the piezoelectric electrodes 30 using the conductor 60.

Figure 9:
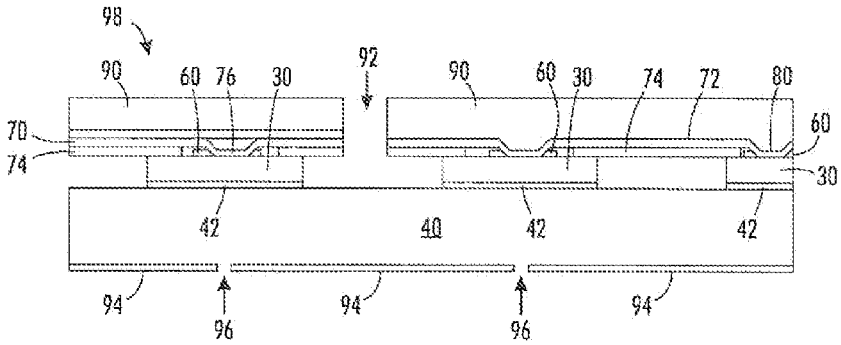
FIG. 9 is a cross section depicting the formation of a jet stack for an ink jet print head.

Next, additional processing can be performed, depending on the design of the device. The additional processing can include, for example, the formation of one or more additional layers which can be conductive, dielectric, patterned, or continuous, and which are represented together schematically by layer 90 as depicted in FIG. 9.

Next, various processing stages can be performed to complete the jet stack, depending on the design of the jet stack subassembly 30. For example, one or more ink port openings 92 can be formed through layer 90 as depicted in FIG. 9. Further, depending on the design of the device, the ink port opening 92 can be formed through a portion of the flex circuits 70, 72, as long as the opening 92 does not result in an electrical open or other undesirable effects. If the ink port opening 92 is formed at the depicted location, the opening 92 can extend through the jet stack subassembly, for example through a jet stack diaphragm. In another embodiment, one or more ink port openings may be formed at a non-depicted location where the flex circuit 70, 72 and/or the piezoelectric array 20 do not reside. In an embodiment, an aperture plate 94 can be attached to the jet stack subassembly 40 with an adhesive (not individually depicted for simplicity) as depicted in FIG. 9. The aperture plate 94 can include nozzles 96 through which ink is expelled during printing. Once the aperture plate 94 is attached, the jet stack 98 is complete. A jet stack 98 can include other layers and processing requirements not depicted or described for simplicity.

Figure 10:
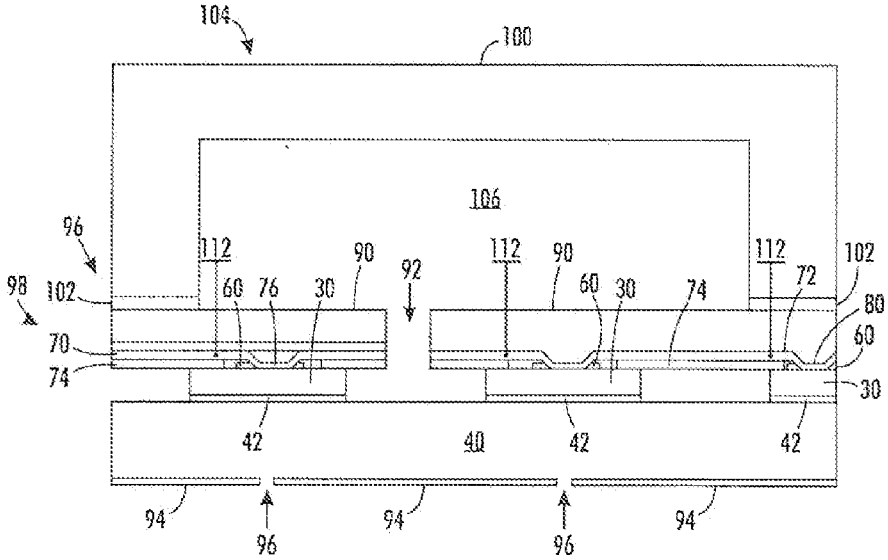
FIG. 10 is a cross section of a print head including the jet stack of FIG. 9.

Next, a manifold 100 can be bonded to the upper surface of the jet stack 98, which physically attaches the manifold 100 to the first flex circuit 70 and the second flex circuit 72. The attachment of the manifold can include the use of a fluid-tight sealed connection 102 such as an adhesive to result in an ink jet print head 104 as depicted in FIG. 10. The ink jet print head 104 can include an ink reservoir 106 formed by a surface of the manifold 100 and the upper surface of the jet stack 98 for storing a volume of ink. Ink from the reservoir 106 can be delivered through ports, for example through one or more ports 92 in the jet stack 98, wherein the ink ports can be provided, in part, by a continuous opening through one or both flex circuits 70, 72, the adhesive 74, and the jet stack subassembly 40. Other configurations for the ink ports, for example as described above, are contemplated. It will be understood that FIG. 10 is a simplified view. An actual print head may include various structures and differences not depicted in FIG. 10, for example additional structures to the left and right, which have not been depicted for simplicity of explanation. While FIG. 10 depicts a single port 92, a jet stack can include a plurality of ports.

In use, the reservoir 106 in the manifold 100 of the print head 104 includes a volume of ink. An initial priming of the print head can be employed to cause ink to flow from the reservoir 106, through the ports 92 in the jet stack 98. Responsive to a voltage 112 placed on each trace 78, 82 which is transferred to the bump electrodes 76, 80, to the conductor 60, and to the piezoelectric electrodes 30, each PZT piezoelectric element 30 bends or deflects at an appropriate time in response. The deflection of the piezoelectric element 30 causes a diaphragm (not individually depicted for simplicity) to flex which creates a pressure pulse within the jet stack 98, causing a drop of ink to be expelled from the nozzle 96.

The methods and structure described above thereby form a jet stack 98 for an ink jet printer. In an embodiment, the jet stack 98 can be used as part of an ink jet print head 120 as depicted in FIG. 11.

Figure 11:
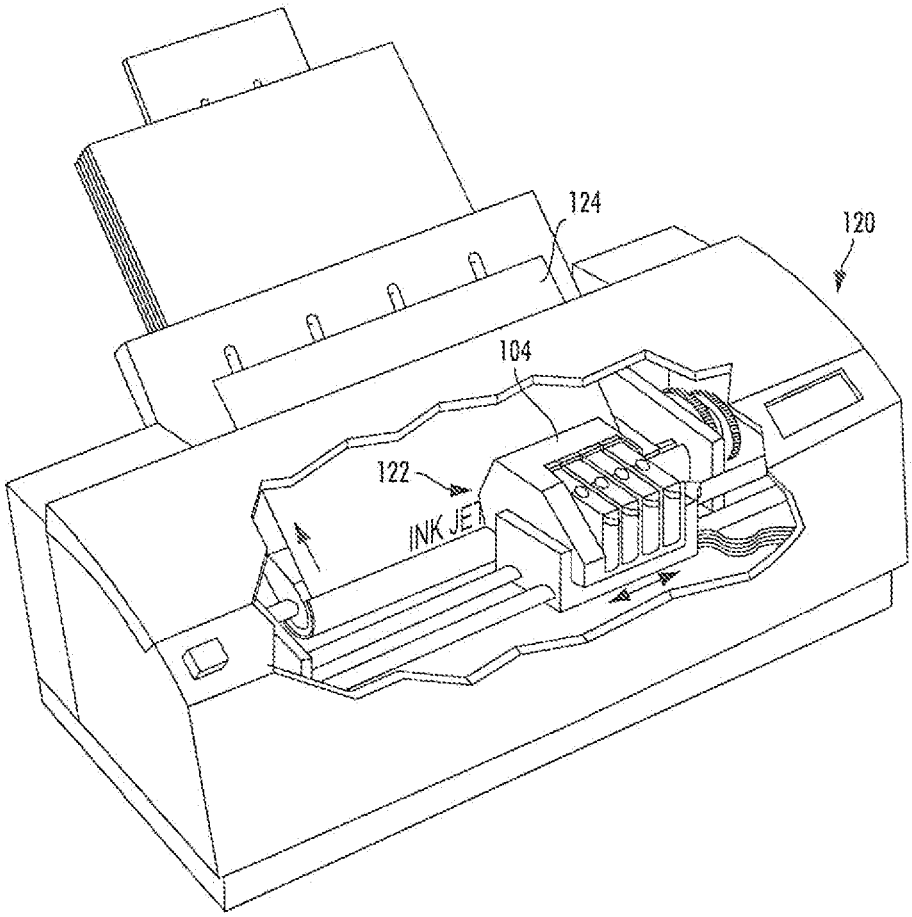
FIG. 11 is a printing device including a print head according to an embodiment of the present teachings.

FIG. 11 depicts a printer 120 including one or more print heads 104 and ink 122 being ejected from one or more nozzles 96 in accordance with an embodiment of the present teachings. Each print head 104 is configured to operate in accordance with digital instructions to create a desired image on a print medium 124 such as a paper sheet, plastic, etc. Each print head 104 may move back and forth relative to the print medium 124 in a scanning motion to generate the printed image swath by swath. Alternately, the print head 104 may be held fixed and the print medium 124 moved relative to it, creating an image as wide as the print head 104 in a single pass. The print head 104 can be narrower than, or as wide as, the print medium 124. In another embodiment, the print head can print to an intermediate surface such as a rotating drum or belt for subsequent transfer to a print medium.

The embodiment described above can thus provide a jet stack for an ink jet print head which can be used in a printer. The method for forming the jet stack, and the completed jet stack, can have two or more flex circuits, and one flex circuit can be stacked on top of another flex circuit. Each flex circuit can be electrically connected with some, but less than all, piezoelectric elements from a print head piezoelectric element array. Each flex circuit can be electrically coupled with a different portion of the piezoelectric element array.

It will be appreciated that embodiments are contemplated which include two or more flex circuits electrically coupled with different portions of a piezoelectric element array, wherein the two or more flex circuits are not stacked on top of each other but lay side by side. While the present teachings are described with reference to two different flex circuits electrically coupled with different portions of a piezoelectric element array, three or more than three flex circuits can be incorporated, wherein each flex circuit is electrically coupled with three or more than three different portions of the piezoelectric element array.

Using two or more flex circuits, wherein each flex circuit is electrically coupled with a different portion of a piezoelectric element array, can reduce the number of traces required on each separate flex circuit. Thus, as piezoelectric element array densities increase, fewer traces will need to be formed between adjacent pads of a pad array than if all the traces were formed on a single flex circuit.

Further, it will be appreciated that as flex circuit manufacturing technology improves and traces can be formed in a tighter space to achieve higher density flex circuits, designing in a new single flex circuit to replace two or more flex circuits will not require a redesign of the print head. Replacement of multiple flex circuits by a single flex circuit is expected to require only a cut-in of the single, higher density flex circuit. The cut-in can occur at a crossover point as the cost of using higher density flex circuits decreases to the point of being less than multiple flex circuits, or as manufacturing, performance, or yield improvements of using a higher density flex circuit become advantageous.

Thus the use of multiple (two or more) flex circuits provides a low cost method to form a high density multi-point electrical interconnect. This method involves using a flexible printed circuit with bumped pads, aligning the circuitry to their respective actuators and affixing the circuits with a non-conductive adhesive. Since the resolution and density of commercially available flexible circuits is limited, multiple flex circuits can be overlapped and shifted to achieve the density and routing required. In one embodiment, multiple flex circuits can be used in an arrangement analogous to shingling on a roof. Advantages include the ability to design a high density head with current flex circuit manufacturing techniques and, in the event the supplier roadmap can achieve higher density circuits, a simple cut-in can be facilitated. Further, by breaking the system down into manageable testable sub-units, yielding pre-tested components can be more cost effective.

Note that while the exemplary method is illustrated and described as a series of acts or events, it will be appreciated that the present invention is not limited by the illustrated ordering of such acts or events. For example, some acts may occur in different orders and/or concurrently with other acts or events apart from those illustrated and/or described herein, in accordance with the present teachings. In addition, not all illustrated steps may be required to implement a methodology in accordance with the present teachings. Other embodiments will become apparent to one of ordinary skill in the art from reference to the description and FIGS. herein.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the wafer or substrate, regardless of the orientation of the wafer or substrate.

The invention claimed is:

1. An ink jet print head, comprising:

a piezoelectric element array comprising a plurality of piezoelectric elements spaced apart from each other;

a first flexible circuit (first flex circuit) comprising a first trace metallization layer, wherein:

the first trace metallization layer comprises a plurality of first traces and a plurality of first embossed pads;

the plurality of first traces are continuous with the plurality of first embossed pads in the first trace metallization layer; and each first embossed pad is electrically coupled to one of the piezoelectric elements;

a second flex circuit comprising a second trace metallization layer, wherein:

the second trace metallization layer comprises a plurality of second traces and a plurality of second embossed pads;

the plurality of second traces are continuous with the plurality of second embossed pads in the second trace metallization layer; and each second embossed pad is electrically coupled to one of the piezoelectric elements, wherein each piezoelectric element is configured to be individually addressable through one of the plurality of first embossed pads and the plurality of second embossed pads, and wherein at least a portion of the first flex circuit is interposed between the second flex circuit and the piezoelectric element array.

2. The ink jet print head of claim 1, wherein spacing between adjacent piezoelectric elements of the piezoelectric element array is about 100 μm or less.

3. The ink jet print head of claim 1, further comprising:

a jet stack subassembly comprising:

a diaphragm attached to the piezoelectric element array;

a body plate attached to the diaphragm; and an inlet/outlet plate attached to the body plate.

4. The ink jet print head of claim 1, further comprising:

the first flex circuit is physically attached to the piezoelectric element array;

the first flex circuit comprises an edge which overlies the piezoelectric element array;

the second flex circuit is physically attached to the first flex circuit and to the piezoelectric element array; and the second flex circuit spans the edge of the first flex circuit and conforms to a vertical step provided by the edge of the first flex circuit.

5. The ink jet print head of claim 1, further comprising a driver board, wherein the first flex circuit and the second flex circuit are electrically coupled to the driver board.

6. The ink jet print head of claim 1, wherein the plurality of first embossed pads and the plurality of second embossed pads are each electrically coupled to one of the plurality of piezoelectric elements using a conductor disposed at a central location of each individual spaced piezoelectric element.

7. The ink jet print head of claim 2, wherein a width of each first trace and each second trace is between about 14 μm and about 25 μm, and a pitch of the first plurality of traces and the second plurality of traces is between about 24 μm and about 50 μm.

8. A printer, comprising:

an ink jet print head comprising:

a piezoelectric element array comprising a plurality of piezoelectric elements spaced apart from each other;

a first flexible circuit (first flex circuit) comprising a first trace metallization layer, wherein:

the first trace metallization layer comprises a plurality of first traces and a plurality of first embossed pads;

the plurality of first traces are continuous with the plurality of first embossed pads in the first trace metallization layer; and each first embossed pad is electrically coupled to one of the piezoelectric elements;

a second flex circuit comprising a second trace metallization layer, wherein:

the second trace metallization layer comprises a plurality of second traces and a plurality of second embossed pads;

the plurality of second traces are continuous with the plurality of second embossed pads in the second trace metallization layer; and each second embossed pad is electrically coupled to one of the piezoelectric elements, wherein each piezoelectric element is configured to be individually addressable through one of the plurality of first embossed pads and the plurality of second embossed pads, and wherein at least a portion of the first flex circuit is interposed between the second flex circuit and the piezoelectric element array;

a manifold physically attached to the first and second flex circuits; and an ink reservoir formed by a surface of the manifold.

9. The printer of claim 8, wherein the plurality of first embossed pads and the plurality of second embossed pads are each electrically coupled to one of the plurality of piezoelectric elements using a conductor disposed at a central location of each individual spaced piezoelectric element.

* * * * *